United States Patent [19]

Schaeffer

[11] Patent Number: 4,674,487

[45] Date of Patent: Jun. 23, 1987

[54] KNUCKLE GUARD

[76] Inventor: Michael A. Schaeffer, 4603 SW. 67th Ter., Gainesville, Fla. 32608

[21] Appl. No.: 759,745

[22] Filed: Jul. 29, 1985

[51] Int. Cl.[4] ..... A61F 5/04

[52] U.S. Cl. ..... 128/87 A; 128/89 R

[58] Field of Search ..... 128/87 A, 89 R, 90, 128/77, 84 R, 85

[56] References Cited

U.S. PATENT DOCUMENTS 653,814 7/1900 Mennes ..... 128/77

1,684,076 9/1928 Smith ..... 128/87 A 1,917,794 7/1933 Brown ..... 128/77

3,680,549 8/1972 Lehneis et al. ..... 128/89 R

*Primary Examiner*—Stephen F. Husar

*Attorney, Agent, or Firm*—Arthur G. Yeager

[57] ABSTRACT

A helical band to be positioned around the second knuckle of the middle finger of the barber's hand which is not used to operate scissors. The band is used when cutting the ends of hair gripped between the index finger and the middle finger and prevents the scissors from cutting the flesh around the second knuckle.

8 Claims, 5 Drawing Figures

KNUCKLE GUARD

BACKGROUND OF THE INVENTION

This invention relates to a finger guard to prevent injury to the finger when cutting hair.

There have been a wide variety of finger guards in the prior art to prevent punctures by needles, to prevent cuts by paring knives, to prevent injury when slicing a foodstuff, etc. Insofar as is known there has never been a suggestion of a finger guard for a barber or hair stylist to employ to prevent inadvertent cutting of the finger by scissors. Frequently a comb is used as a solid backing against which scissors are operated to cut hair projecting between the teeth of the comb. Other times, however, the hair cutter grips a few locks of hair between fingers and cuts off the tips of that hair with scissors. In the act of so doing the scissors may nip the skin around the second knuckle.

It is an object of this invention to provide a knuckle guard to prevent scissor cuts. It is another object of this invention to provide an adjustable helical band to wrap around a finger and protect it while cutting hair. Still other objects will appear from the more detailed description which follows.

BRIEF DESCRIPTION OF THE INVENTION

This invention relates to a knuckle guard for the middle finger of a hand comprising a unitary helical band adapted to encircle the second knuckle of the middle finger, said guard having a proximal end portion and a distal end portion connected to each other by a helical band adapted to wrap around said middle finger at the second knuckle, said proximal end portion extending to adjacent the first knuckle and being sufficiently broad to cover the top and side of a portion of the second knuckle adjacent the index finger, said distal end extending adjacently beyond said second knuckle and covering the top and side of a portion of the second knuckle and middle finger adjacent the index finger.

In specific embodiments of the invention there is a lateral extension tab to cover the top of the proximal plalanx of the middle finger so as to provide protection for that finger from adjacent the first knuckle to below the second knuckle.

BRIEF DESCRIPTION OF THE DRAWINGS

The novel features believed to be characteristic of this invention are set forth with particularity in the appended claims. The invention itself, hoever, both as to its organization and method of operation, together with further objects and advantages thereof, may best be understood by reference to the following description taken in connection with the accompanying drawings in which:

DETAILED DESCRIPTION OF THE INVENTION

Figure 5:
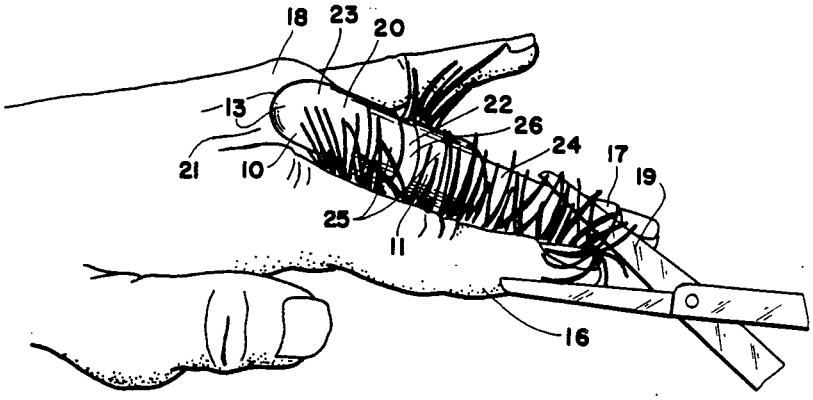
FIG. 5 is a schematic view of the use of the knuckle guard of this invention in cutting hair held between the index finger and the middle finger.
Figure 1:
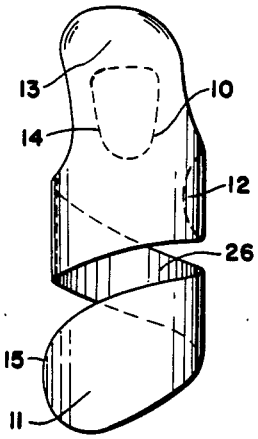
FIG. 1 is a front elevation view of the knuckle guard of this invention as seen by looking as the back of the hand.
Figure 2:
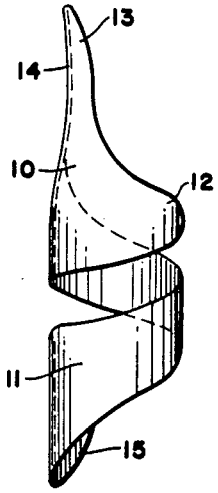
FIG. 2 is a side elevation view of the knuckle guard of this invention as seen by looking from the little finger.
Figure 3:
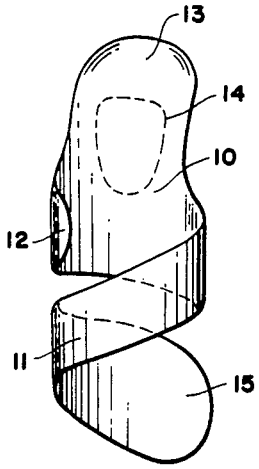
FIG. 3 is a back elevation view of the knuckle guard of this invention as seen by looking at the palm of the hand.
Figure 4:
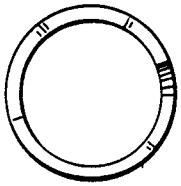
FIG. 4 is a top plan view of the knuckle guard as seen in FIG. 1.

The general configuration of the knuckle guard of this invention is shown in FIGS. 1–4.

The guard is a helical band extending from a proximal end portion 10 to a distal end portion 11. Proximal end portion 10 lies over the proximal phalanx of the middle finger, i.e. the finger bone closest to the palm of the hand and extending from the first knuckle (next to the palm) to the second knuckle (middle joint of the three joints of the finger). Distal end portion 11 lies over the end of the second phalanx (middle finger bone) next to the second knuckle.

Proximal end portion 10 includes the upper end 12 of the helical band which grips the side of the first phalanx between the middle finger and the ring finger. A lateral extension tab 13 extends upward toward the first knuckle to provide a protective cover over the upper portion of the first phalanx. Tab 13 includes a flat spot 14 which is designed to provide a pressure zone that assists in holding the knuckle guard in place without any twisting around the finger.

The remainder of the knuckle guard from upper end 12 to lower end 15 is a helical band which wraps around the second knuckle of the middle finger and therefore can be made to spring open or closed so as to be adjustable to different sizes of fingers. Upper end 12 is positioned on the side of the first phalanx facing the ring finger. The band then passes up and over the top of the middle finger and down the side facing the index finger. From this point the band extends under the finger up the side facing the ring finger, over the top of the finger, and down the side facing the index finger to lower end 15 which is on the side facing the index finger. Space 26 between parallel portions of the band should be reasonably small, e.g. $\frac{1}{8}$–$\frac{1}{4}$ inch so as to prevent the skin of the finger from bulging outward and being cut by the hair stylist's scissors.

The knuckle guard is preferably made of metal, e.g. stainless steel or aluminum, but may also be made of plastic, e.g. polyolefin, polyamide, polyacetal, polystyrene, polyacrylic, or the like. The material employed should be thin enough to permit a springiness in the structure and light enough not to be burdensome to wear. Thickness of about 0.010 inch to about 0.050 inch is preferred.

FIG. 5 shows the usage of the knuckle guard of this invention which is preferred. Guard 20 is placed over middle finger 17 with lateral extension tab 13 adjacent first knuckle 21 of that finger. The guard may be twisted slightly toward index finger 16 so as to cover as much of the visible surface of middle finger as possible when viewed from the side as shown in FIG. 5. Space 26 between parallel portions of the helical band of the guard 20 will fall over second knuckle 22 or just below second knuckle 22. Proximal phalanx 23, second knuckle 22, and the upper portion of middle phalanx 24 are all protected by guard 20 except for finger skin at space 26.

The hair cutter frequently grasps hair 25 between middle finger 17 and index finger 16, with both fingers fully extended and with index finger 16 under middle finger 17. The hair 25 projecting outward between fingers 16 and 17 is then cut off by scissors 19. This operation frequently in the past resulted in injury to the skin of the middle finger 17 around second knuckle 22. When knuckle guard 20 is in place, scissors 19 can be guided along the surface of guard 20 to clip hair 25 without danger of cutting the skin of middle finger 17.

It is of course to be understood that FIGS. 1–5 show the knuckle guard used by a right handed hair stylist, i.e. one who uses scissors in the right hand and the knuckle guard on the left hand. For a left handed hair stylists the knuckle guard will be the mirror image of that shown in the drawings.

While the invention has been described with respect to certain specific embodiments, it will be appreciated that may modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A knuckle guard for the middle finger of a hand comprising a unitary thin, wide helical band of about 1–1½ turns adapted to encircle the second knuckle of the middle finger, said guard having a proximal end portion and a distal end portion connected to each other to form a helical band of about 1–1½ turns adapted to wrap around said middle finger at the second knuckle and being sufficiently broad to cover the top and side of a portion of the second knuckle adjacent the index finger, said distal end portion extending adjacently beyond said second knuckle and covering the top and side of a portion of the second knuckle and middle finger adjacent the index finger.

2. The knuckle guard of claim 1 wherein said proximal end portion includes a saddle-shaped lateral extension tab having a rounded center section adapted to fit over the top of the proximal phalanx and the adjacent portion of the first knuckle and an upper end adapted to wrap around a portion of the side of said proximal phalanx adjacent the ring finger.

3. The knuckle guard of claim 1 wherein said distal end portion includes a helical band extending from a position overlying the side of said second knukcle adjacent the index finger to wrap around the underneath portion of said second knuckle and over the top of the middle phalanx adjacent said second knuckle.

4. The knuckle guard of claim 2 wherein said distal end portion and said proximal end portion form a continuous helical band wrapped around said middle finger with the spacing between adjacent parallel portions of said band being much smaller than the width of said band.

5. The knuckle guard of claim 3 wherein said distal end portion and said proximal end portion form a continuous helical band wrapped around said middle finger with the spacing between adjacent parallel portions of said band being much smaller than the width of said band.

6. The knuckle guard of claim 2 wherein said rounded center section includes a flat area positioned to contact the top of said middle finger proximal phalanx adjacent the end of said proximal portion near said first knuckle.

7. The knuckle guard for use on the middle finger of a barber, said guard comprising a unitary thin, wide helical band of about 1–1½ turns to be placed over the second knuckle and extending above and below said knuckle to cover a portion of each of said proximal phalanx and said middle phalanx, respectively; the end of the band covering said proximal phalanx having a lateral extension to overlie the top of said proximal phalanx adjacent the first knuckle; and the end of the band covering a portion of the middle phalanx terminating on the side of the middle finger adjacent the index finger.

8. The knuckle guard of claim 7 wherein the end of said band adjacent the proximal phalanx begins on the side of said phalanx adjacent the ring finger, extends over the top of the middle finger at the second knuckle, down the side adjacent the index finger, underneath the middle finger and up the side adjacent the ring finger, over the top of the middle finger at the proximal end of the middle phalanx, and terminates medially of the side of the middle finger adjacent the index finger; said band including a lateral extension tab extending along the top of the proximal phalanx to adjacent said first knuckle.

* * * * *